US005935332A

United States Patent [19]

Caucal

[11] Patent Number: 5,935,332

[45] Date of Patent: Aug. 10, 1999

[54] PLANT FOR PREPARING AND FEEDING A COATING COMPOSITION TO A COATING HEAD FOR PAPER OR THE LIKE

[75] Inventor: Jean-Paul Caucal, Aix les Bains, France

[73] Assignee: Cellier Groupe S.A., France

[21] Appl. No.: 08/808,602

[22] Filed: Feb. 28, 1997

[30] Foreign Application Priority Data

Mar. 5, 1996 [FR] France ..... 96 02993

[51] Int. Cl.[6] ..... B05C 3/00; B05C 19/02

[52] U.S. Cl. ..... 118/429; 118/600; 118/612; 118/663; 118/688; 118/689; 118/693; 118/694; 366/152.1; 366/152.2; 366/153.1; 366/160.2

[58] Field of Search ..... 118/429, 600, 118/612, 663, 688, 689, 693, 694; 366/152.1, 152.2, 153.1, 160.2

[56] References Cited

U.S. PATENT DOCUMENTS

| | | | |
|---|---|---|---|
| 3,129,115 | 4/1964 | Clarke et al. | 118/694 |
| 3,877,682 | 4/1975 | Moss | 366/152.2 |
| 4,121,535 | 10/1978 | Roberts, Jr. et al. . | |
| 4,259,022 | 3/1981 | Folland | 366/152.2 |
| 4,403,866 | 9/1983 | Falcoff et al. | 366/152.1 |
| 4,433,917 | 2/1984 | Mendel et al. | 366/152.2 |
| 4,457,258 | 7/1984 | Cocks | 18/612 |
| 4,683,837 | 8/1987 | Linke et al. | 118/694 |
| 4,773,764 | 9/1988 | Colombani et al. | 366/150 |

FOREIGN PATENT DOCUMENTS

| | | |
|---|---|---|
| 2029384 | 10/1970 | France . |
| 2647461 | 11/1990 | France . |
| 91/17820 | 11/1991 | WIPO . |

OTHER PUBLICATIONS

Considine, Douglas, Van Nostrand Reinhold Encyclopedia of Chemistry, 4th ed. p. 459, 1984.

*Primary Examiner*—Peter Chin
*Assistant Examiner*—Michael P. Colaianni
*Attorney, Agent, or Firm*—Wall Marjama Bilinski & Burr

[57] ABSTRACT

A plant for preparing and feeding a coating composition to a coating head for paper or the like includes a plurality of hoppers, each hopper being intended to receive and deliver one ingredient of the composition. The plant further includes a premixer tank which is fed by the hoppers and mixes and homogenizes the formed composition and a homogenizing tank, fed by the premixer tank, having a high-speed stirrer for shearing the composition. A buffer capacity is directly and continuously fed by the homogenizing tank and connected to the coating head, wherein the buffer capacity preferably has a volume and an attached level detector for determining when the composition in the buffer capacity is below a predetermined level. A set of controllers attached to the level detector control the delivery of components from the plurality of hoppers.

12 Claims, 4 Drawing Sheets

PLANT FOR PREPARING AND FEEDING A COATING COMPOSITION TO A COATING HEAD FOR PAPER OR THE LIKE

FIELD OF THE INVENTION

The invention relates to the field of the paper industry and more precisely to paper coating plants. It relates more precisely to plant for preparing and metering the composition intended to feed the coating head.

BACKGROUND OF THE INVENTION

In a known manner, in a coating plant the coating head is fed with a composition commonly called "coating color". This coating color consists of the mixture and the mixing of different pigments, fillers and binders intended to impart particular visual and feel properties.

The preparation of this coating color is carried out in a mixing unit generally called a "coating kitchen". Two main techniques, differing in their principle, are generally employed for ensuring the metering and the feeding of the coating head. Thus, there is a known technique commonly called "batch", in which the various ingredients of the coating color, which are contained in specific metering hoppers, are poured in selected quantities into a mixing and storage tank. When the stirring and mixing operation is finished, the quantity of color produced is poured into the circuit connected to the coating head. The operation of preparing the color and its injection into the circuit feeding the coating head are thus independent and necessarily consecutive. It follows that the overall operation of the plant is noncontinuous, and this requires the presence of relatively costly storage stock vessels.

Furthermore, plants intended to overcome this disadvantage, which operate continuously, are also known. Thus, in this solution the various storage hoppers pour the coating ingredients directly into the circuit feeding the coating head, while they undergo mixing. Although it increases the speed of starting up the plant, this solution requires extremely accurate metering means making it possible to deliver the exact quantity of pigments or binders that are required for the quality of coating color which is adopted. These means of accurate metering increase the overall cost of a plant.

The problem which the invention is therefore intended to solve is to provide a coating kitchen allowing operation which is flexible with regard to the feeding of the coating head, which delivers a color of quality that is strictly uniform in time, and which does not require metering means that are special and of high accuracy.

SUMMARY OF THE INVENTION

The invention therefore relates to a plant for preparing and feeding a coating composition to a coating head for paper or the like, including a plurality of hoppers, each intended to receive and deliver one ingredient of the composition.

The characteristics of this plant are that it comprises:

- a premixer tank fed by the various hoppers, intended to mix and to homogenize the composition formed;
- a homogenizing tank fed by the premixer tank, comprising means for shearing the composition;
- a buffer capacity directly and continuously fed by the homogenizing tank, connected to the coating head;
- means for detecting a requirement for the composition of the coating head;

- and controlling means connected to said means of detection in order to feed the premixer tank with ingredients issuing from the hoppers.

In other words, the plant in accordance with the invention comprises means for simultaneously carrying out, on the one hand, the metering and the mixing of the various ingredients to obtain the coating color and, on the other hand, the continuous feeding of the coating head with the color thus prepared. To put it another way, the plant combines the advantages of an accurate and independent metering with those of a continuous feeding of the coating head and without any interruption.

In a first alternative form the premixer comprises a detector of the composition level, in order to actuate the means for controlling the feeding of ingredients.

In other words, according to a first control strategy, the triggering of the metering results from the surveillance of the level in the premixer. Thus, when the level in this premixer reaches a bottom threshold, the various metering hoppers pour a portion of their content into the premixer.

In an advantageous geometry, at its lower end the premixer tank adopts a frustoconical form in which the level detector and a stirrer are placed.

The plant advantageously comprises a draining pump placed in the circuit between the premixer and the reactor. In this way the draining of the premixer is ensured at a steady flow rate, this being regardless of the viscosity of the liquid. The flow times are therefore uniform.

As already stated, the invention consists in carrying out a noncontinuous metering of the various ingredients making up the coating color and at the same time ensuring a continuous feeding of the coating head with this color. Thus, in an advantageous embodiment, the homogenizing tank into which the mixture produced in the premixer is poured at regular intervals comprises a high-speed stirrer to ensure the dispersion of the composition by shearing.

As already stated, after dispersion, the coating color is poured into a buffer capacity directly connected to the pump situated in the circuit in the direction of the coating head.

The buffer capacity advantageously has a detector of the composition level to actuate the feeding of the homogenizing tank. In a different way, in this alternative form of embodiment the requirement for coating color, corresponds to a bottom threshold of composition in its buffer capacity and this, when reached, causes the opening of a valve and the operation of the draining pump which are situated between the premixer and the homogenizing tank.

Advantageously, in practice, the feeding of the buffer capacity by the homogenizing tank is performed by means of an overflow.

In order to ensure, in accordance with the problems posed, a continuity of the feeding which is compatible with a noncontinuous metering of the coating color, the volume of the buffer capacity is greater than the working volume of the premixer tank.

In another alternative form of embodiment the circuit included between the buffer capacity and the coating head includes a sensor for actuating means for controlling the feeding of the ingredients into the premixer tank.

In other words, in this other architecture, which corresponds to a different control strategy, the noncontinuous metering corresponding to the feeding of the premixer is triggered by flow-rate or level thresholds which are observed downstream of the actual coating kitchen.

In a particular embodiment the hoppers, the premixer tank, the homogenizing tank and the buffer capacity additionally have means for feeding and washing with water.

BRIEF DESCRIPTION OF THE DRAWINGS

The manner of carrying out the invention, and the advantages which stem therefrom, will emerge clearly from the description of the embodiment which follows, supported by the appended figures, in which.

DETAILED DESCRIPTION OF THE INVENTION

Figure 1:
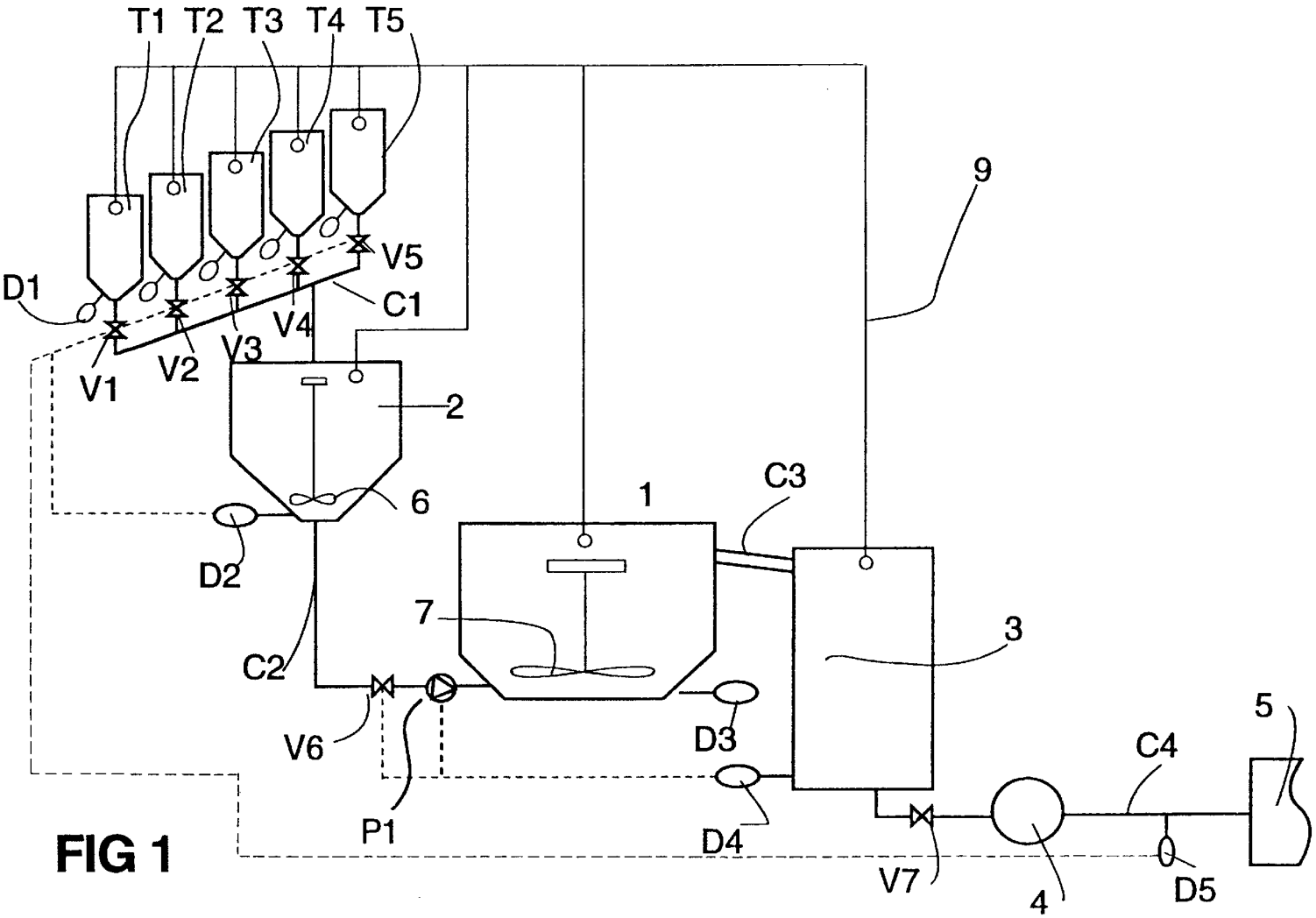
FIG. 1 is a simplified diagrammatic view of a coating kitchen in accordance with a preferred embodiment of the invention.

In a known manner, a coating kitchen includes a plurality of unit stock vessels (not shown) containing ingredients needed for the composition of the coating color. The various units and members making up the coating kitchen are intended to ensure the mixing and the production of a sufficient quantity to feed the circuit (C4) leading to the actual coating unit (5).

In accordance with the invention the various storage vessels are connected by any known means to a plurality of metering hoppers (T1–T5). To keep the drawings clear, the number of hoppers shown is five, but it goes without saying that the principle of the invention applies to a much greater number of hoppers. Each of these metering hoppers (T1–T5) is connected to a circuit (C1) which opens into a characteristic premixer (2). Each hopper is equipped with a level sensor (D1) and a valve (V1–V5) making it possible to control the feeding of the premixer. Each of these hoppers is situated at a level which is higher than that of the premixer, with the result that the flow into this premixer (2) takes place under gravity.

The premixer (2) includes especially means for stirring (6) and a sensor (D2) capable of determining the quantity of liquid which it contains.

This premixer (2) is connected, via a circuit (C2) in which there is an isolation valve (V6) and a pump (P1), for example of the positive delivery type, to a high-capacity homogenizing tank (1). This homogenizing tank (1) comprises means (7) making it possible to ensure the dispersion of the coating color by shearing, by high-speed rotation (several thousand revolutions per minute), this being in order to ensure homogenization of the coating color. The circuit (C2) allows the coating color which is not yet dispersed to be introduced into the bottom part of the homogenizing tank. The latter is equipped with a level detector (D3).

In accordance with an essential characteristic of the invention, the homogenizing tank (1) is used in combination with a buffer capacity (3) into which flows the coating color dispersed by the homogenizing tank (1). In a preferred embodiment this flow takes place via an overflow circuit (C3) connected to the top part of the homogenizing tank (1). In accordance with a fundamental characteristic of the invention it is important that the volume of this buffer capacity (3) should be greater than the working volume of the premixer (2), this being to ensure continuous feeding of the coating head (5) during the stage of metering by filling the premixer (2). This buffer capacity can be formed by an actual tank or else by a simple pipeline of diameter enabling the abovementioned volume criterion to be obeyed.

This buffer capacity (3) is connected via the circuit (C4) to the unit for feeding (5) of the coating head. A valve (V7) placed in this circuit (C4) upstream of the transfer pump (4) allows the coating kitchen to be isolated from the unit for feeding the coating head (5).

Figure 2:
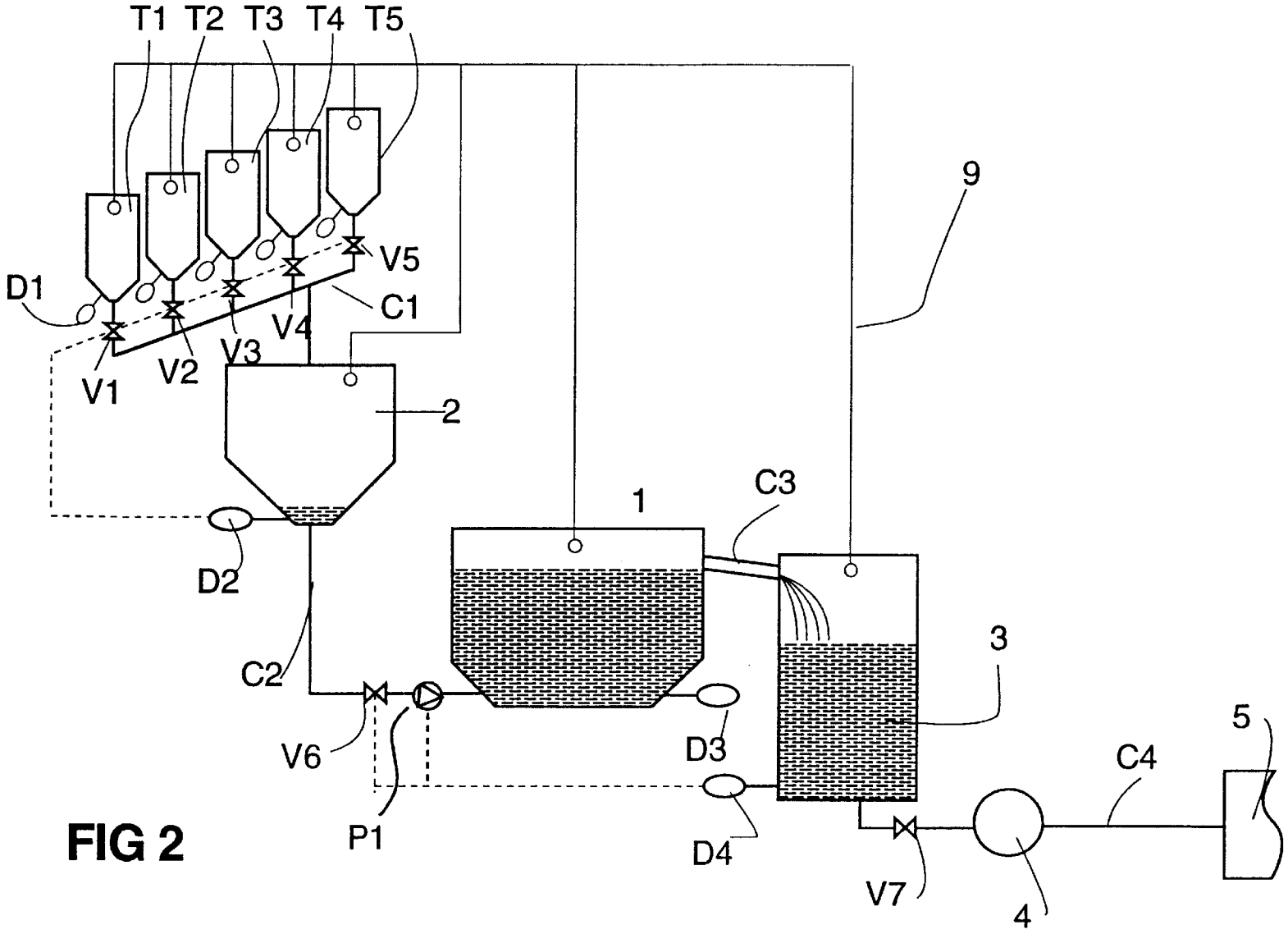
FIG. 2 is a simplified diagrammatic view of a first stage of the operation of the coating kitchen of FIG. 1 in which the buffer capacity is filled.
Figure 3:
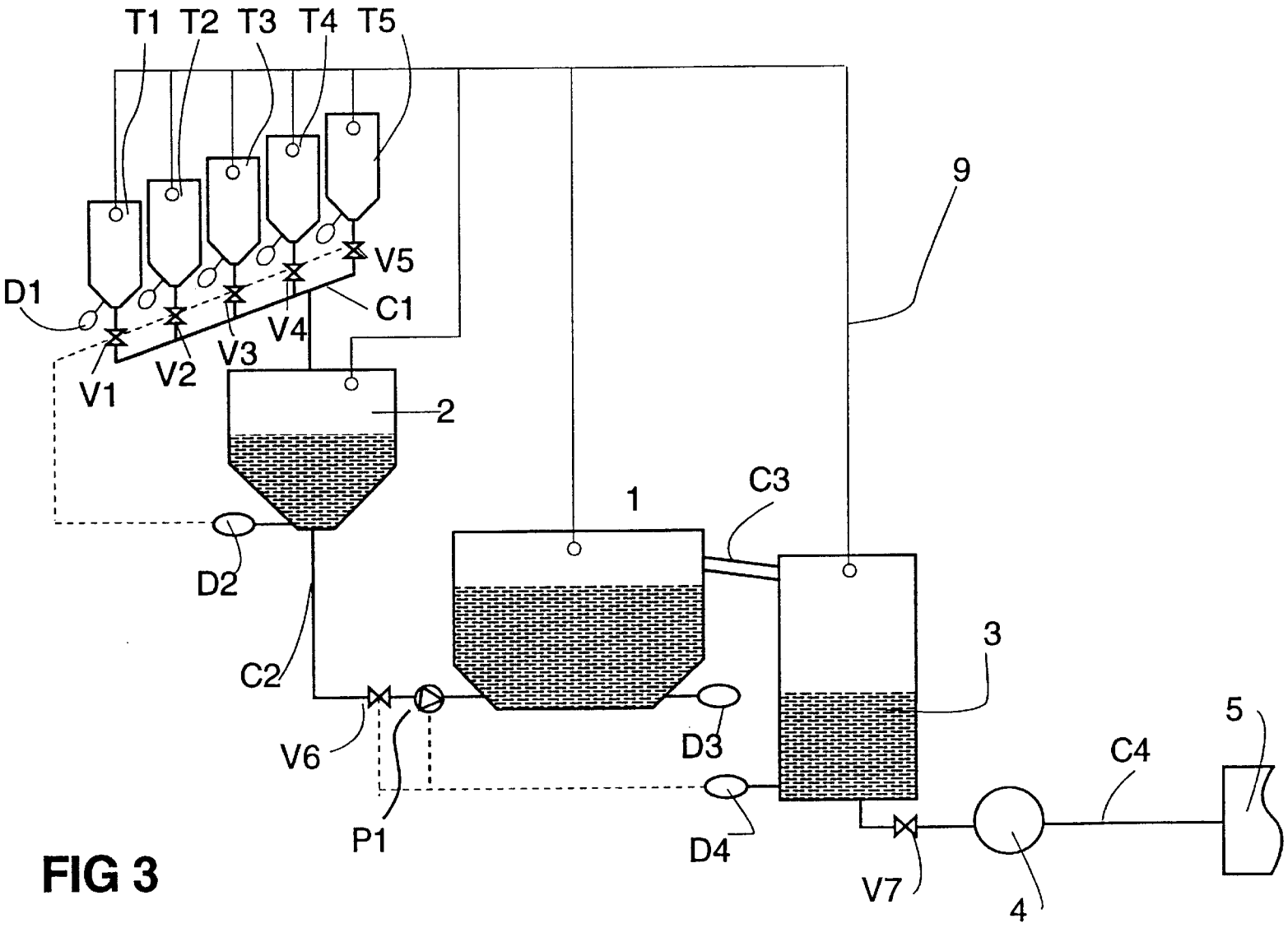
FIG. 3 is the diagrammatic view of the coating kitchen of FIGS. 1 and 2, at a subsequent stage of the operation in which the level in the buffer capacity decreases while the premixer is being filled.

As shown in FIGS. 1–3, the hoppers (T1–T5), the premixer tank (1) and the buffer capacity (3) each include means (9) for feeding and washing with water.

The operation of the coating kitchen in accordance with the invention is as follows.

Thus, FIG. 2 illustrates the stage of the operation during which the homogenizing tank (1) has just received a quantity of composition issuing from the premixer (2), not yet dispersed. At this time the valve (V6) has just closed again and the means for stirring and shearing (7) perform their dispersing action. The upper region of the homogenizing tank, where the coating composition already sheared is situated, overflows via the circuit (C3) into the buffer capacity (3).

In a second stage of operation of the coating kitchen illustrated in FIG. 3 the level in the capacity (3) is becoming lower as a result of the continuous consumption by the coating head, via the circuit (C4). In parallel and simultaneously the bottom level in the premixer (2), detected by the sensor (D2), causes the opening of the valves (V1–V5) for determined times allowing the flow of predetermined and calculated quantities in order to obtain the chosen metering. Thus the premixer (2) therefore is being filled while the capacity (3) is being emptied.

In accordance with an essential characteristic of the invention the filling time of the premixer must be shorter than the draining time of the capacity (3). During this intermediate second stage the level in the homogenizing tank drops, and this stops the overflow phenomenon.

Figure 4:
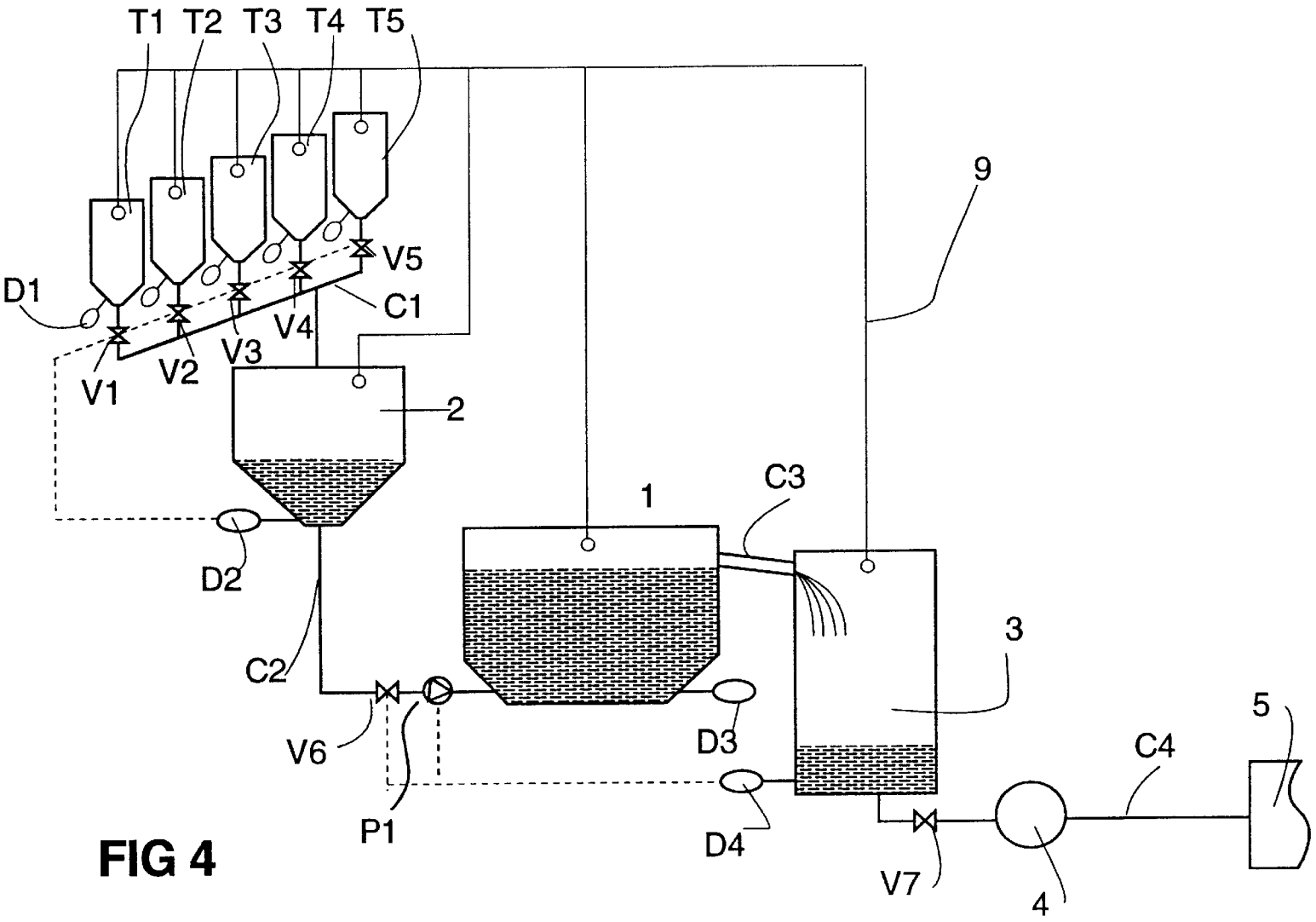
FIG. 4 is the diagrammatic view of FIGS. 1–3 of the coating kitchen at a stage following the draining of the premixer.

In the third stage of operation of the coating kitchen, illustrated in FIG. 4, valves V1 to V5 are both closed again, following the filling of the premixer, being controlled by the sensor (D2). After these closures, when the level in the capacity (3) reaches a bottom threshold detected by the sensor (D4), the valve (V6) is opened and the pump (P1) is actuated to ensure the draining of the premixer (2) into the homogenizing tank (1) via the circuit (C2). It follows that the level in the homogenizing tank (1) rises again and that the overflow circuit (C3) is again carrying the sheared color which fills the capacity (3). The stage of operation corresponding to FIG. 2 then takes place again.

Of course, the invention is not restricted to this described embodiment, but also covers other alternative forms which are not described in detail, in which the sequencing of the various stages of operation is, for example, ensured by a sensor (D5) situated in the circuit leading to the unit for feeding the coating head (5).

From the above it follows that the coating kitchen in accordance with the invention makes it possible to ensure a noncontinuous metering of the various ingredients of the coating color simultaneously with a continuous feeding of the unit for feeding the coating head. It follows that, on the one hand, the operation of the latter is essentially continuous, which enables its periods of use to be optimized, and that, on the other hand, the means necessary for the metering are relatively simple and inexpensive.

I claim:

1. Apparatus for preparing and feeding a coating composition to a coating head used for paper products comprising:

a plurality of hoppers, each of said hoppers having actuable means for receiving and delivering one ingredient of the coating composition;

a premixer tank interconnected to each of said delivering means, said premixer tank being noncontinuously fed by said delivering means;

homogenizing means included in said premixer tank for mixing and initially homogenizing the coating composition formed by a compound of all said delivered ingredients;

a homogenizing tank fed by the premixer tank comprising means for shearing and ensuring the homogenization of the coating composition;

a buffer capacity directly and continuously fed by the homogenizing tank, said buffer capacity being interconnected to the coating head;

means for detecting when said buffer capacity is below a predetermined level; and control means connected to said detecting means for causing said actuating means to deliver ingredients to said premixer tank when said buffer capacity is below the predetermined level wherein the volume of the buffer capacity is greater than the volume of the premixer tank to allow continuous operation thereof.

2. Apparatus as recited in claim 1, wherein the premixer tank includes a level detector, said level detector being interconnected to each of said delivering means to cause actuation thereof when said premixer tank is below a predetermined level.

3. Apparatus as recited in claim 1, wherein said mixing and homogenizing means includes a stirrer mechanism, said premixer tank including a lower frustoconical portion sized for retaining said stirrer mechanism and said level detector.

4. Apparatus as recited in claim 1, including a draining pump interconnectably disposed between said premixer tank and said homogenizing tank.

5. Apparatus as recited in claim 1, wherein said shearing means includes a high-speed stirrer to ensure the dispersion of the coating composition.

6. Apparatus as recited in claim 1, wherein said detecting means includes a level detector disposed in said buffer capacity.

7. Apparatus as recited in claim 1, wherein said buffer capacity is interconnected to the top of said homogenizing tank, said reactor tank feeding said buffer capacity when the coating composition in said homogenizing tank exceeds a predetermined level.

8. Apparatus as recited in claim 1, including a circuit between the buffer capacity and the coating head, said circuit having a sensor interconnected to said control means to control the feeding of ingredients into the premixer tank.

9. Apparatus as recited in claim 1, wherein said plurality of hoppers, said premixer tank, said homogenizing tank, and said buffer capacity each include means for feeding and washing with water.

10. Apparatus as recited in claim 1, wherein said shearing means includes a high speed stirrer to ensure the dispersion of said coating composition, said stirrer being located in a lower portion of said homogenizing tank.

11. Apparatus as recited in claim 10, wherein said premixer tank is interconnected to said homogenizing tank by a draining line, said line extending from a lower portion of said premixer tank directly to said high speed stirrer to ensure dispersion of said composition entering said homogenizing tank.

12. Apparatus as recited in claim 11, wherein said homogenizing tank includes an overflow connection connected to said buffer capacity, said overflow connection being provided in an upper portion of said homogenizing tank.

* * * * *